US011337505B2

(12) United States Patent
Zhong

(10) Patent No.: US 11,337,505 B2
(45) Date of Patent: May 24, 2022

(54) COSMETIC CONTAINER WITH AN ADJUSTABLE DISCHARGE QUANTITY

(71) Applicant: SHYA HSIN PACKAGING INDUSTRY (CHINA) CO., LTD., Kunshan (CN)

(72) Inventor: Hua Zhong, Kunshan (CN)

(73) Assignee: SHYA HSIN PACKAGING INDUSTRY (CHINA) CO., LTD., Kunshan (CN)

( * ) Notice: Subject to any disclaimer, the term of this patent is extended or adjusted under 35 U.S.C. 154(b) by 19 days.

(21) Appl. No.: 17/259,199

(22) PCT Filed: Sep. 23, 2019

(86) PCT No.: PCT/CN2019/107189
§ 371 (c)(1),
(2) Date: Jan. 11, 2021

(87) PCT Pub. No.: WO2020/206948
PCT Pub. Date: Oct. 15, 2020

(65) Prior Publication Data

US 2021/0251366 A1 Aug. 19, 2021

(30) Foreign Application Priority Data

Apr. 12, 2019 (CN) ..... 201910294817.7

(51) Int. Cl.
*A45D 34/04* (2006.01)
*B65D 47/18* (2006.01)
*B01L 3/02* (2006.01)

(52) U.S. Cl.
CPC ..... *A45D 34/04* (2013.01); *B01L 3/0282* (2013.01); *B65D 47/18* (2013.01); *A45D 2200/051* (2013.01); *A45D 2200/055* (2013.01)

(58) Field of Classification Search
CPC ..... B01L 3/0224; B01L 3/021; B01L 3/0217; B01L 3/0275; B01L 3/0279;
(Continued)

(56) References Cited

U.S. PATENT DOCUMENTS 3,101,751 A * 8/1963 Ballin ..... B01L 3/0282 422/934
6,164,498 A * 12/2000 Faughey ..... A61J 7/0053 222/321.6

(Continued)

FOREIGN PATENT DOCUMENTS

CN 203194868 U 9/2013
CN 203342972 U 12/2013

(Continued)

*Primary Examiner* — Patrick M. Buechner
(74) *Attorney, Agent, or Firm* — Bayramoglu Law Offices LLC

(57) ABSTRACT

A cosmetic container with an adjustable discharge quantity includes a container body, an inner cover, an outer cover, a button, a piston, and an elastic member. The upper part of the container body is provided with an opening. The inner wall of the inner cover is threadedly connected to the opening of the container body, and the inner cover extends upward to form an inner cylinder. A plurality of stepped grooves with different depths are arranged in parallel in a movement area of the outer wall of the inner cylinder. The lower end of the inner cover is hermetically connected to a dropper. The outer cover is fixedly connected to the inner cover. The button is inserted between the inner cover and the outer cover. The piston is sleeved on a piston connecting rod of the button and moves up and down with the button.

10 Claims, 11 Drawing Sheets

(58) Field of Classification Search
CPC .... B01L 3/0282; B01L 3/0272; B01L 3/0206; A45D 34/04; A45D 40/26; A45D 2200/051; A45D 2200/055; A45D 2034/002; B65D 47/18; G01F 11/088; B05B 11/3007; B05B 11/3047
See application file for complete search history.

(56) References Cited

U.S. PATENT DOCUMENTS

| | | | | |
|---|---|---|---|---|
| 9,237,793 | B2 | 1/2016 | Choi | |
| 9,347,811 | B2 * | 5/2016 | Wang | G01F 11/084 |
| 2013/0074983 | A1 * | 3/2013 | Choi | A45D 34/00 141/23 |
| 2014/0209206 | A1 * | 7/2014 | Wang | G01F 11/084 141/24 |
| 2014/0209636 | A1 * | 7/2014 | Wang | B05B 11/3002 222/384 |
| 2014/0234007 | A1 * | 8/2014 | Lee | B65D 51/32 401/121 |
| 2015/0320175 | A1 * | 11/2015 | Lee | B05B 11/3001 222/372 |
| 2017/0006999 | A1 * | 1/2017 | Moon | A45D 34/04 |
| 2018/0042363 | A1 * | 2/2018 | Kim | A45D 40/265 |

FOREIGN PATENT DOCUMENTS

| | | | |
|---|---|---|---|
| CN | 204861717 | U | 12/2015 |
| CN | 107000922 | A | 8/2017 |
| CN | 107073498 | A | 8/2017 |
| CN | 107529869 | A | 1/2018 |
| CN | 109965486 | A | 7/2019 |

* cited by examiner

COSMETIC CONTAINER WITH AN ADJUSTABLE DISCHARGE QUANTITY

CROSS REFERENCE TO THE RELATED APPLICATIONS

This application is the national phase entry of International Application No. PCT/CN2019/107189, filed on Sep. 23, 2019, which is based upon and claims priority to Chinese Patent Application No. 201910294817.7, filed on Apr. 12, 2019, the entire contents of which are incorporated herein by reference.

TECHNICAL FIELD

The present invention relates to a cosmetic container, and more particularly, to a cosmetic container with an adjustable discharge quantity.

BACKGROUND

In order to prevent functional cosmetic products from being contaminated or resulting in waste during use, droppers are typically adopted to retrieve the desired cosmetics by suction and accurately dispense the cosmetics to the target part of the user, which would be more economical. At present, however, the retrieved quantity of the dropper is typically fixed. If the user uses an excess of cosmetics, it will not only cause waste of cosmetics, but also may cause side effects on the skin of the users. If the user uses less cosmetics, it is insufficient to achieve the desired effect during use, and the cosmetics need to be pumped for retrieval many times, which causes much inconvenience to the user.

SUMMARY

In order to overcome the above-mentioned shortcomings, the present invention provides a cosmetic container with an adjustable discharge quantity. A dropper in the cosmetic container is provided with a plurality of different grades, and each grade corresponds to a different quantity of retrieved cosmetics. In use, the users can reasonably choose the retrieved quantity each time according to their needs, which is user-friendly.

In order to solve the technical problems, the present invention adopts the following technical solution.

A cosmetic container with an adjustable discharge quantity includes:

a container body, wherein the upper part of the container body is provided with an opening;

an inner cover, wherein the inner wall of the inner cover is threadedly connected to the opening of the container body, and the inner cover extends upward to form an inner cylinder; the outer wall of the inner cylinder is provided with a movement area, and a plurality of stepped grooves with different depths are arranged in parallel in the movement area; the lower end of the inner cover is hermetically connected to a dropper;

an outer cover, wherein the outer cover is sleeved on the outer side of the inner cover and fixedly connected to the inner cover;

a button, wherein the button is inserted between the inner cover and the outer cover, and the button is stopped by the outer cover; the inner wall of the button is provided with a grade adjusting rib, and the center of the button extends downward to form a piston connecting rod; the grade adjusting rib is aligned with the different stepped grooves by rotating the button, and then the grade adjusting rib moves down along the stepped groove to the bottom of the stepped groove by pressing the button;

a piston, wherein the piston is sleeved on the piston connecting rod of the button and moves up and down with the button; and an elastic member, wherein the elastic member elastically supports the button.

Preferably, the inner cover extends upward to form an outer cylinder and form the inner cylinder inside the outer cylinder, and a gap is formed between the outer cylinder and the inner cylinder. A connecting tube extending downward is arranged under the inner cylinder, and the inner side of the connecting tube is provided with a receiving groove. The upper end of the dropper is provided with a flange extending radially outward. The dropper is inserted in the connecting tube, and the flange is exactly fixed in the receiving groove. The inner cylinder communicates with the connecting tube.

Preferably, the upper end of the outer cover forms a stopping portion extending radially inward, and the outer wall of the button forms a stopping ring extending radially outward. The stopping ring exactly abuts the inner side of the stopping portion of the outer cover during installation.

Preferably, the piston is hermetically attached to the inner wall of the inner cylinder, and the piston is fixedly engaged with the piston connecting rod of the button.

Preferably, the elastic member is sleeved on the button and located in the inner cover. The upper end of the elastic member abuts the button, and the lower end of the elastic member abuts the inner cover.

Preferably, the movement area on the inner cylinder is a notch with a surface recessed inward. The grade adjusting rib on the button rotates in the movement area and is stopped by other areas of the inner cylinder. The stepped grooves are arranged vertically along the movement area, and openings of the upper ends of all stepped grooves are located at an identical level. When the button is in a natural state, the lowest end of the grade adjusting rib is flush with the openings of the stepped grooves.

Preferably, an arc protrusion is arranged between two adjacent stepped grooves. At least one stepped groove exactly receives the grade adjusting rib of the button, that is, the button is not allowed to move down when the grade adjusting rib is in this stepped groove.

Preferably, the inner cylinder is provided with two symmetrical movement areas, and an identical number of stepped grooves are arranged in each of the two movement areas. The button is correspondingly provided with two grade adjusting ribs.

Preferably, a mounting groove is arranged in the inner cover, and a gasket is mounted in the mounting groove. The gasket is hermetically arranged at the opening of the container body.

Preferably, a scraping member is sleeved on the opening of the container body, and the inner wall of the scraping member is tightly sleeved on the outer wall of the dropper.

The present invention has the following advantages. The present invention includes, from top to bottom, a button, a cover body including an inner cover and an outer cover, a dropper and a container body. The inner cover and the outer cover are fixedly connected through a clamping groove and a protrusion, and the dropper is enabled to retrieve a certain quantity of cosmetics by pressing the button. According to the present invention, a group of stepped grooves with different depths are arranged on the inner cover, and the grade adjusting rib on the button, when located in different stepped grooves with different depths, moves downward different distances, so that the quantities of retrieved cosmetics are also different, thus meeting the different needs of users. The present invention has the advantages of simple operation, material saving, safety, hygiene, and has high usability.

Figure 1:
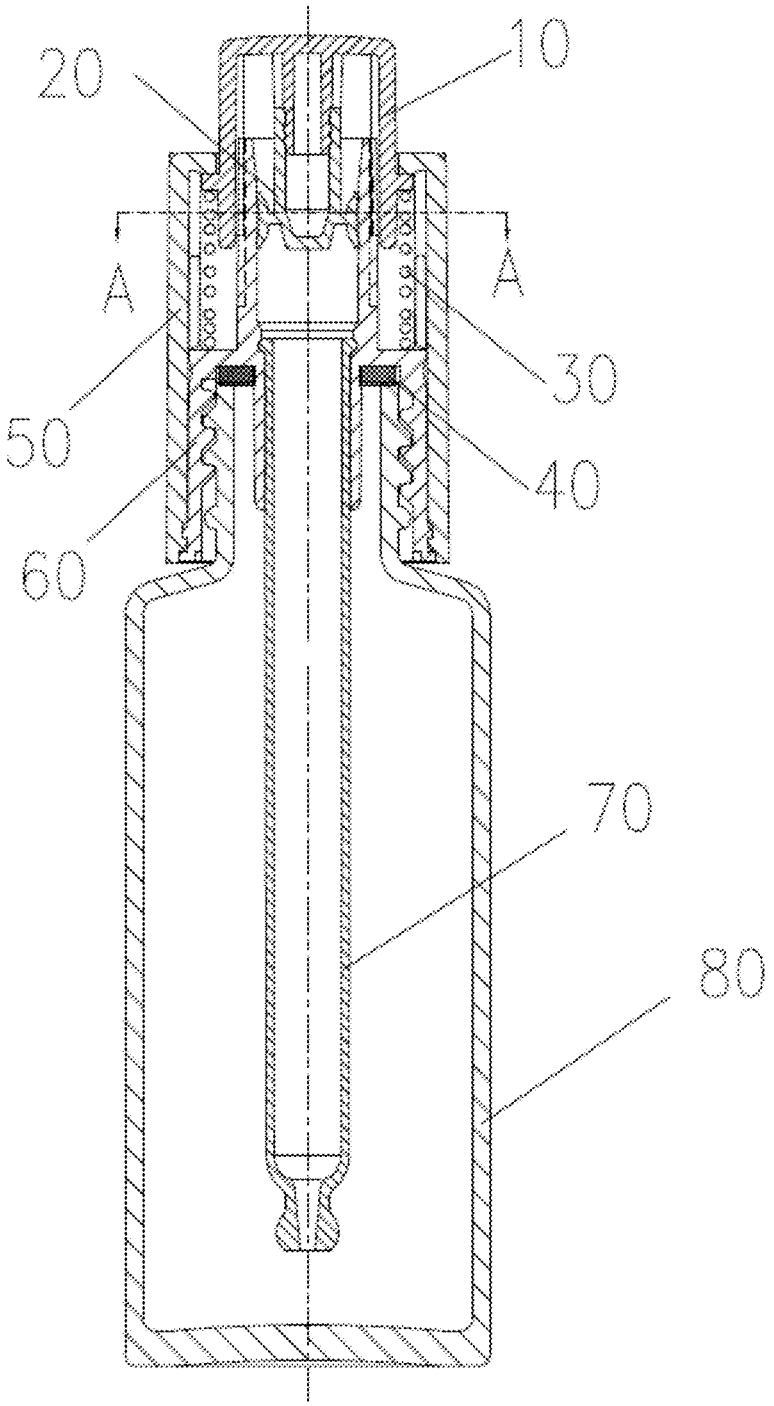
FIG. 1 is a schematic diagram of the structure of the present invention.
Figure 2:
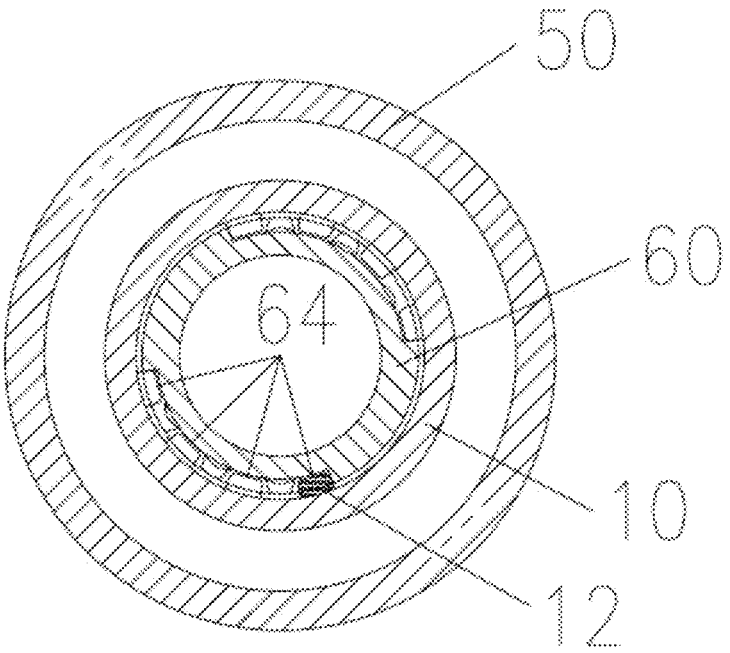
FIG. 2 is a cross-sectional view taken along arrow A-A in FIG. 5.
Figure 3:
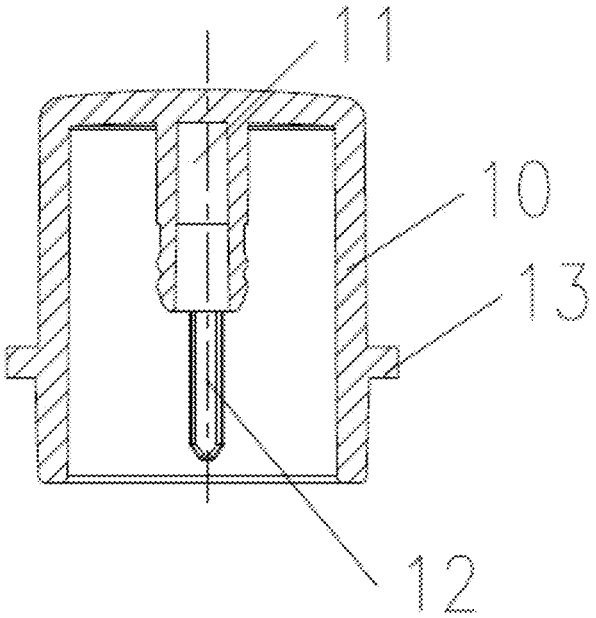
FIG. 3 is a schematic diagram of the structure of a button according to the present invention.
Figure 4:
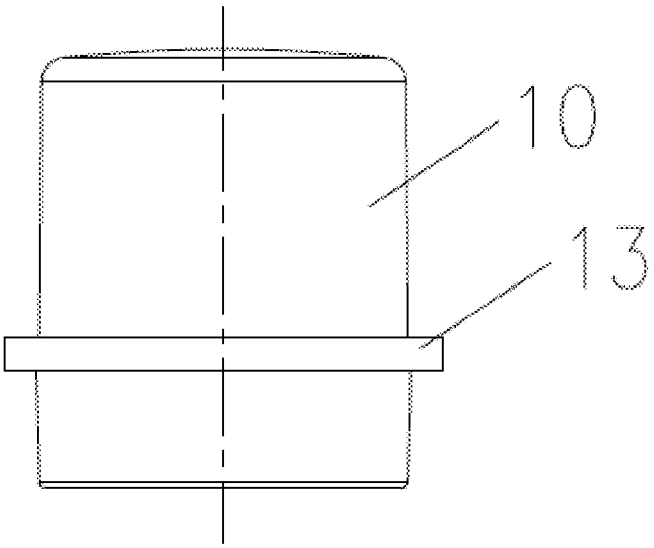
FIG. 4 is a front view of the button according to the present invention.
Figure 5:
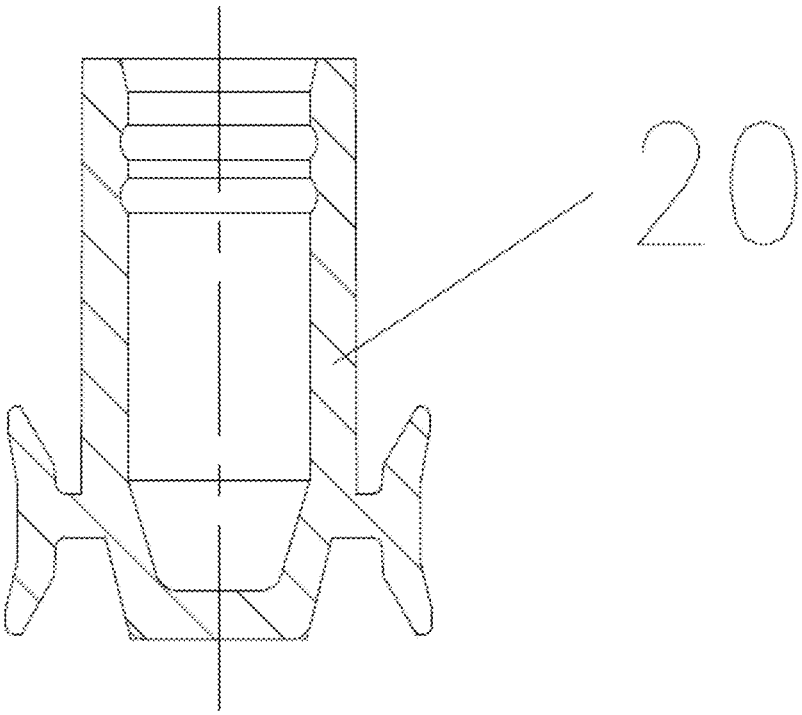
FIG. 5 is a schematic diagram of the structure of a piston according to the present invention.

In the figures: 10—button, 11—piston connecting rod, 12—grade adjusting rib, 13—stopping ring, 20—piston, 30—elastic member, 40—gasket, 50—outer cover, 51—stopping portion, 60—inner cover, 61—outer cylinder, 62—inner cylinder, 63—connecting tube, 64—stepped groove, 65—receiving groove, 66—gap, 67—mounting groove, 70—dropper, 71—flange, 80—container body.

DETAILED DESCRIPTION OF THE EMBODIMENTS

The technical solutions in the embodiments of the present invention will be described clearly and completely in combination with the embodiments of the present invention. It is obvious that the described embodiments are only a part of the embodiments of the present invention, rather than all the embodiments of the present invention. Based on the embodiments of the present invention, all other embodiments obtained by those having ordinary skill in the art without creative efforts shall fall within the scope of protection of the present invention.

Embodiment

As shown in FIGS. 1-13, a cosmetic container with an adjustable discharge quantity includes the container body 80, the inner cover 60, the outer cover 50, the button 10, the piston 20 and the elastic member 30. The upper part of the container body is provided with an opening. The inner wall of the inner cover is threadedly connected to the opening of the container body 80, and the inner cover extends upward to form the inner cylinder 62. The outer wall of the inner cylinder 62 is provided with a movement area, and a plurality of stepped grooves 64 with different depths are arranged in parallel in the movement area. The lower end of the inner cover is hermetically connected to the dropper 70. The outer cover 50 is sleeved on the outer side of the inner cover 60 and fixedly connected to the inner cover 60. The button 10 is inserted between the inner cover 60 and the outer cover 50, and the button is stopped by the outer cover. The inner wall of the button 10 is provided with the grade adjusting rib 12, and the center of the button extends downward to form the piston connecting rod 11. The grade adjusting rib 12 is capable of being aligned with the different stepped grooves 64 by rotating the button, and then the grade adjusting rib 12 moves down along the stepped groove to the bottom of the stepped groove by pressing the button. The piston 20 is sleeved on the piston connecting rod 11 of the button and moves up and down with the button. The elastic member 30 elastically supports the button 10. The present invention includes, from top to bottom, a button, a cover body including an inner cover and an outer cover, a dropper and a container body. The inner cover and the outer cover are fixedly connected through a clamping groove and a protrusion, and a gap is formed between the upper part of the inner cover and the upper part of the outer cover. The button 10 is sleeved on the upper end of the inner cover and placed in the gap. The stopping portion of the outer cover 50 is configured to limit the upward movement of the button so that the button is located inside the cover body. The button 10 is capable of both rotating relative to the inner cover 60 and moving up and down relative to the inner cover. The area where the button rotates is limited to the movement area of the inner cylinder 62. The elastic member 30 is sleeved on the button 10 and located in the gap between the outer cylinder 61 and the inner cylinder 62, and the elastic member 30 is configured to reset the button. The lower end of the button 10 is fixedly connected to the piston 20, and the piston is hermetically connected to the inner wall of the inner cylinder 62. The lower end of the inner cover 60 is hermetically connected to the dropper 70, and the dropper is placed in the container body 80. The container body is configured to store cosmetics, and the container body is threadedly connected to the inner cover. Therefore, the air in the dropper is expelled when the piston moves down, and the dropper retrieves the cosmetics by suction when the piston is reset to the initial position under the action of the elastic member.

According to the present invention, a group of stepped grooves with different depths are arranged on the inner cover, and the grade adjusting rib 12 on the button, when located in different stepped grooves, moves downward different distances, so that the quantities of retrieved cosmetics are also different, thus meeting the different needs of users. The present invention has the advantages of simple operation, material saving, safety, hygiene, and has high usability. The present invention is suitable for liquid cosmetics. In use, the user rotates the cover body to separate the cover body from the container body 80, and then rotates the top button 10 to a position corresponding to the desired discharge quantity. The button is pressed so that the piston 20 moves down along the inner wall of the inner cylinder to squeeze the air out of the dropper. After the user releases the button, the button drives the piston 20 to move upward under the elastic force of the elastic member (i.e., the spring), so that the dropper retrieves the cosmetics. The user only needs to remove the cover body and then press the button 10 to squeeze out the cosmetics in the dropper for use.

The elastic member 30 is sleeved on the button and located in the inner cover 60. The upper end of the elastic member abuts the button 10, and the lower end of the elastic member abuts the inner cover 60. The elastic member may be a spring or the like. The upper end of the elastic member is sleeved on the outer side of the button, and the lower end of the elastic member is placed in the gap 66 between the inner cylinder and the outer cylinder. Normally, the elastic member is in a natural state. When the button is pressed, the elastic member is compressed and deformed, and after the button is released, the restoring force of the elastic member pushes the button upward to the initial position. The piston 20 is hermetically attached to the inner wall of the inner cylinder 62, and the piston is fixedly engaged with the piston connecting rod 11 of the button.

Figure 6:
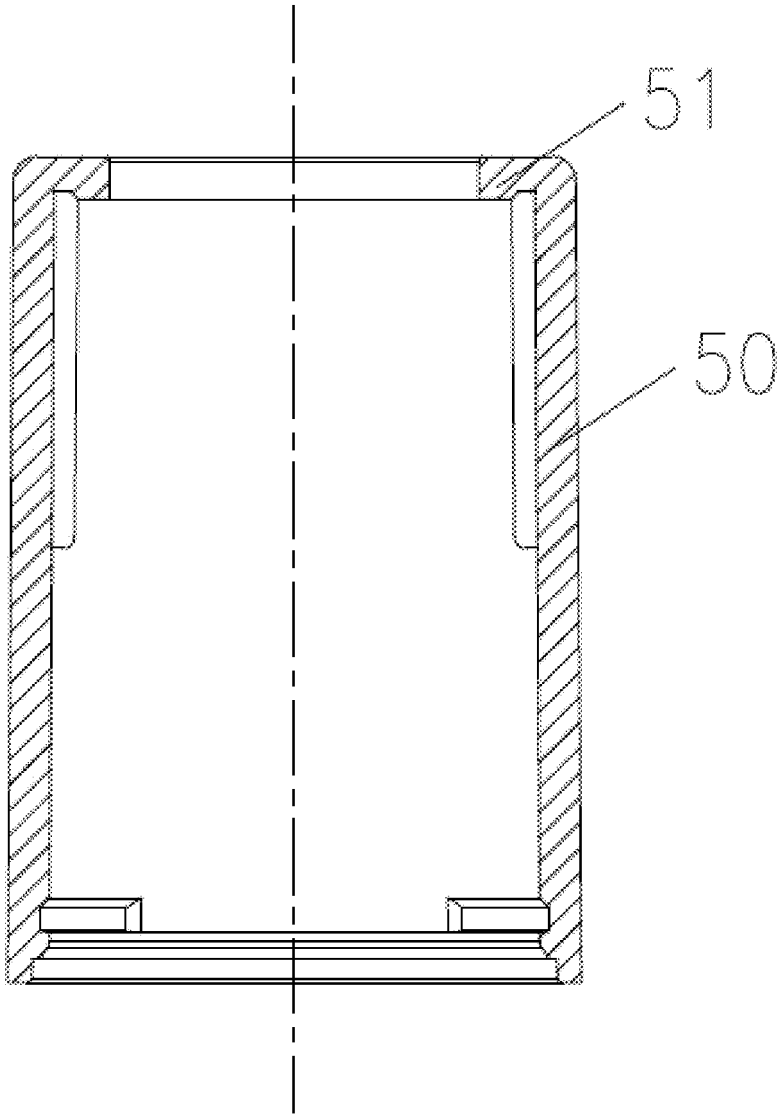
FIG. 6 is a schematic diagram of the structure of an outer cover according to the present invention.

As shown in FIG. 6, the upper end of the outer cover 50 forms the stopping portion 51 extending radially inward, and the outer wall of the button 10 forms the stopping ring 13 extending radially outward. The stopping ring 13 exactly abuts the inner side of the stopping portion 51 of the outer cover during installation. The position of the button is limited by the cooperation between the stopping ring and the stopping portion.

Figure 7:
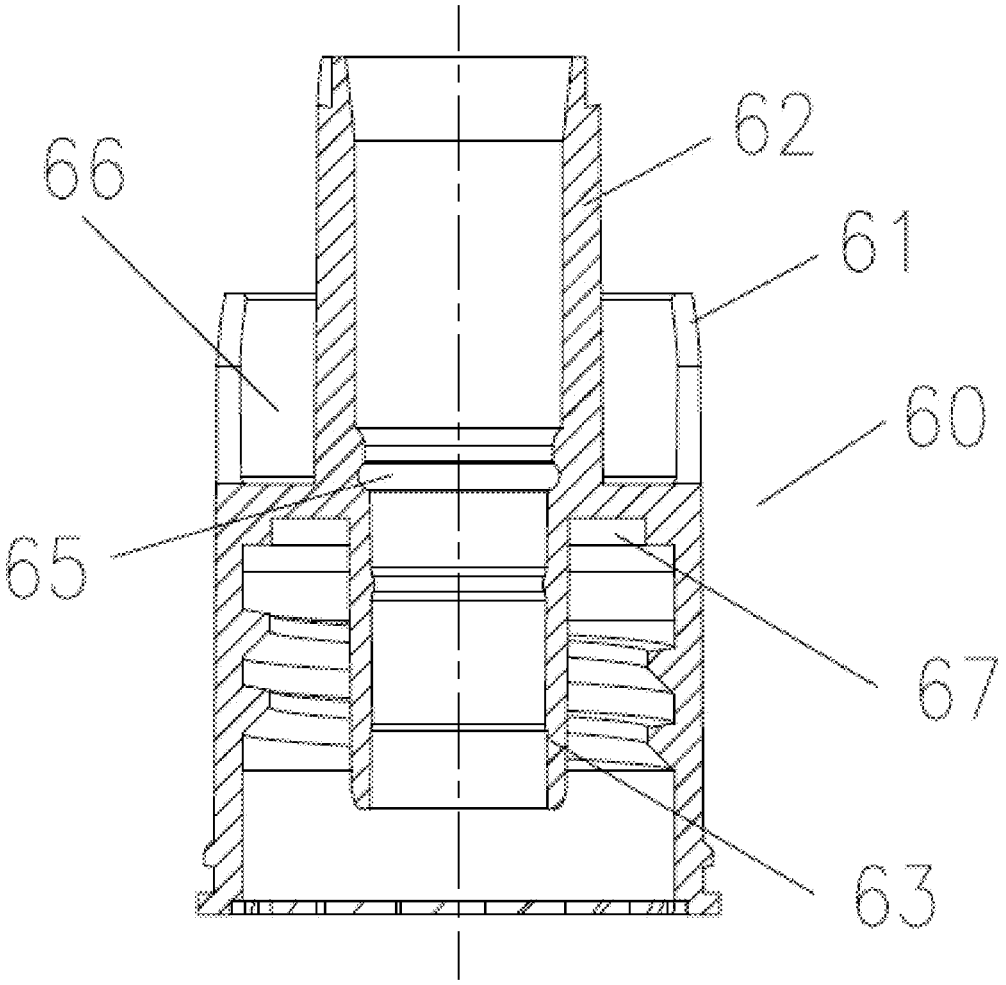
FIG. 7 is a schematic diagram of the structure of an inner cover according to the present invention.

As shown in FIG. 7, the inner cover 60 extends upward to form the outer cylinder 61 and form the inner cylinder 62 inside the outer cylinder 61, and the gap 66 is formed between the outer cylinder 61 and the inner cylinder 62. The connecting tube 63 extending downward is arranged under the inner cylinder 62, and the inner side of the connecting tube 63 is provided with the receiving groove 65. The upper end of the dropper 70 is provided with the flange 71 extending radially outward. The dropper is inserted in the connecting tube 63, and the flange 71 is exactly fixed in the receiving groove 65. The inner cylinder 62 communicates with the connecting tube 63. The inner cover 60 includes an upper part and a lower part. The upper part of the inner cover 60 includes the inner cylinder and the outer cylinder, and the lower part of the inner cover 60 includes a threaded tube and the connecting tube. The outer cylinder does not communicate with the threaded tube, while the inner cylinder vertically communicates with the connecting tube. The piston connected to the button 10 is inserted into the inner wall of the inner cylinder 62. The grade adjusting rib on the button is located in the movement area arranged on the outer wall of the inner cylinder. The inner wall of the threaded tube is provided with an internal thread, and the opening of the container body 80 is threadedly connected to the internal thread. The connecting tube 63 is configured to fix the dropper 70, and the discharge port at the lower end of the dropper 70 is tapered to facilitate taking and discharging the material.

Figure 8:
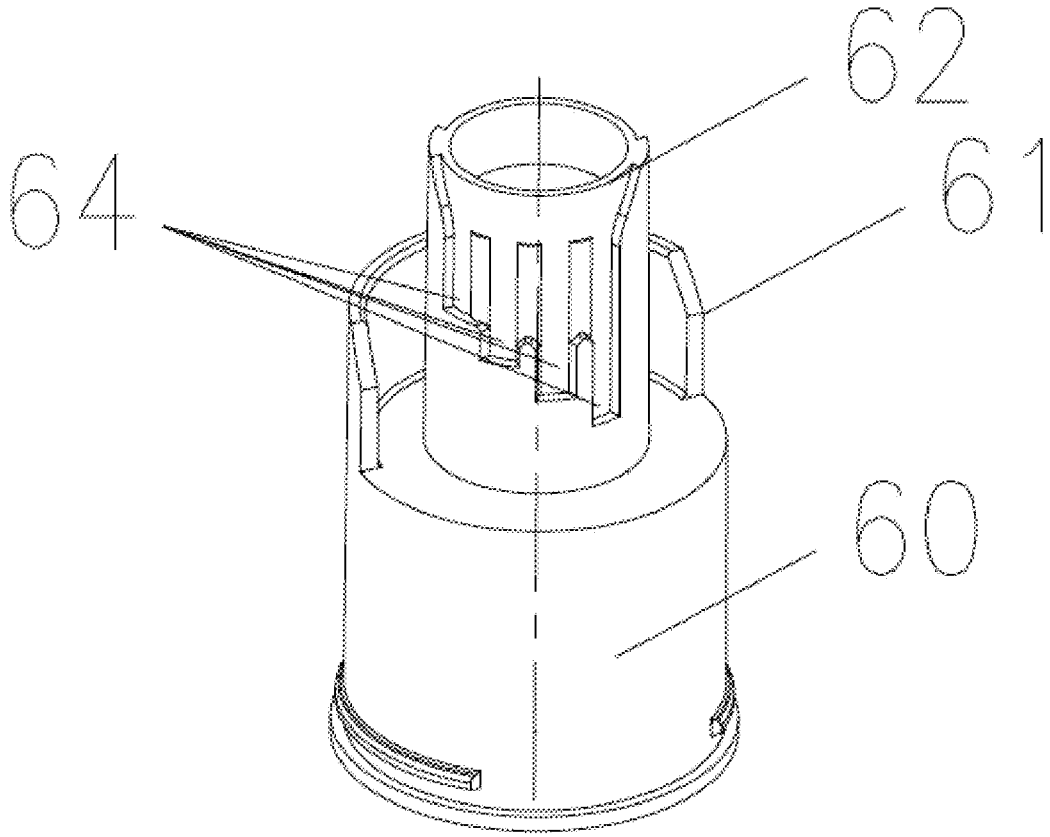
FIG. 8 is a perspective view of the inner cover according to the present invention.
Figure 9:
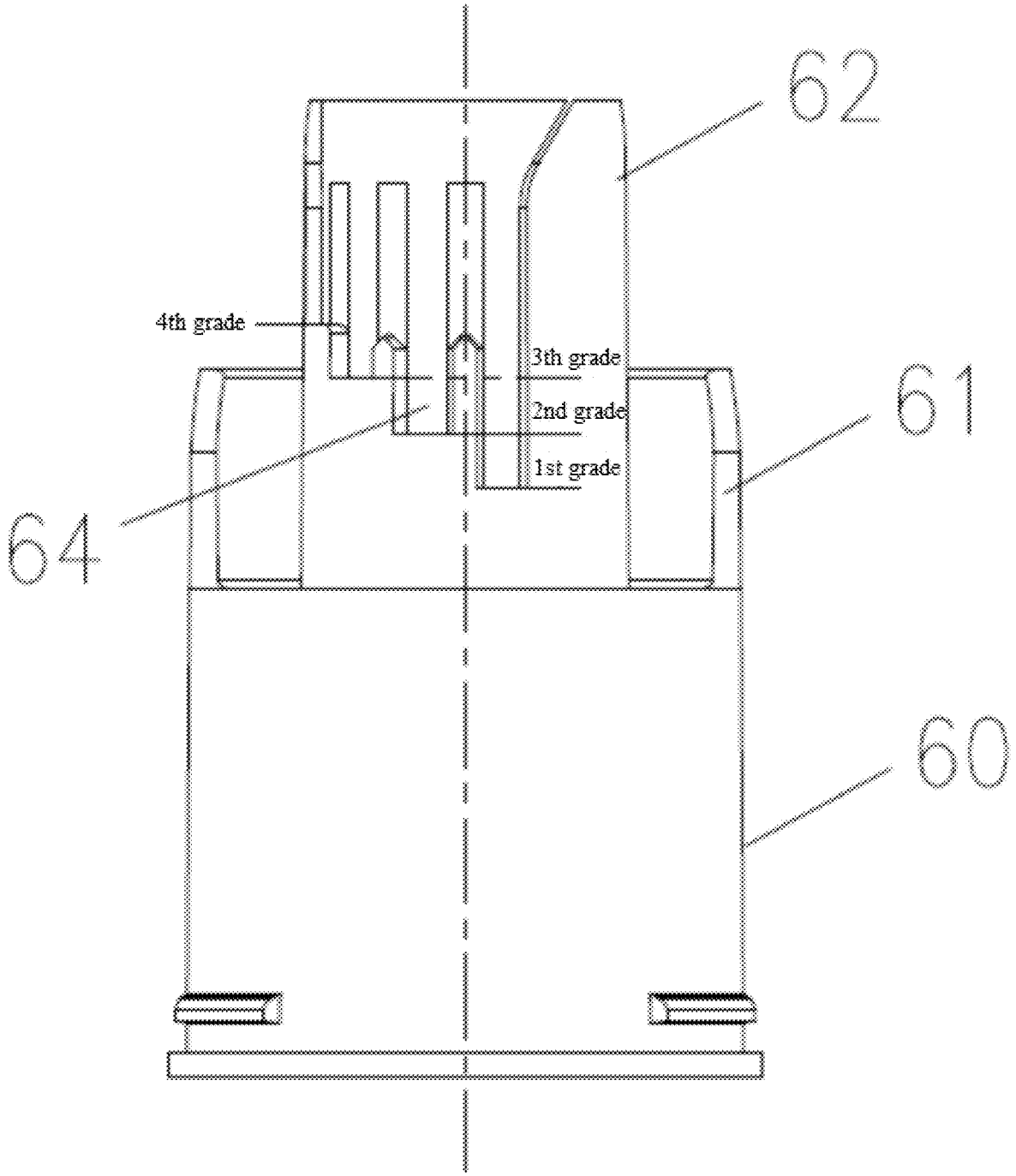
FIG. 9 is a side view of the inner cover according to the present invention.
Figure 10:
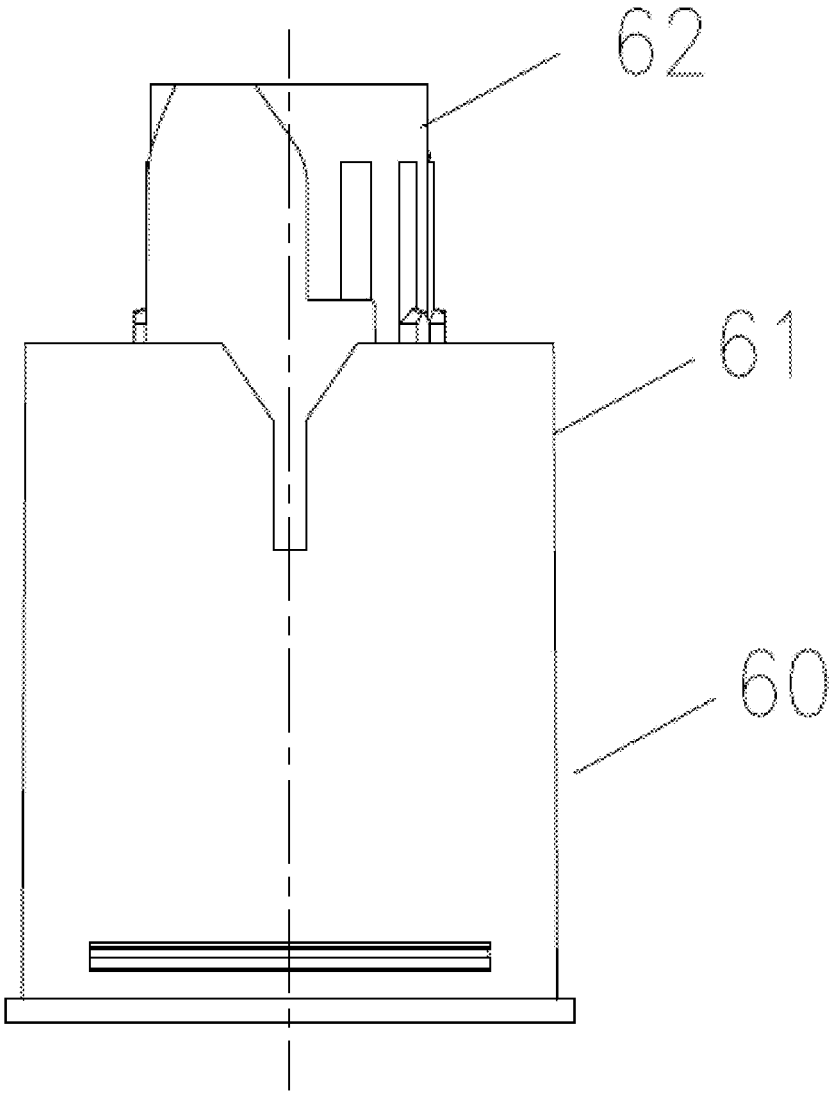
FIG. 10 is a front view of the inner cover according to the present invention.
Figure 11:
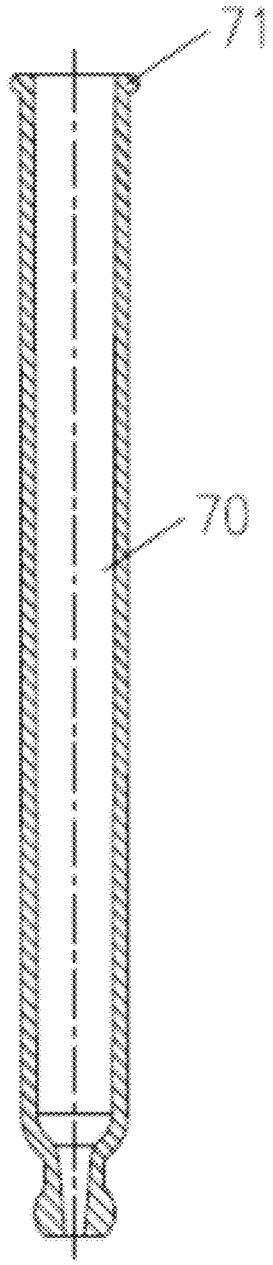
FIG. 11 is a schematic diagram of the structure of a dropper according to the present invention.
Figure 12:
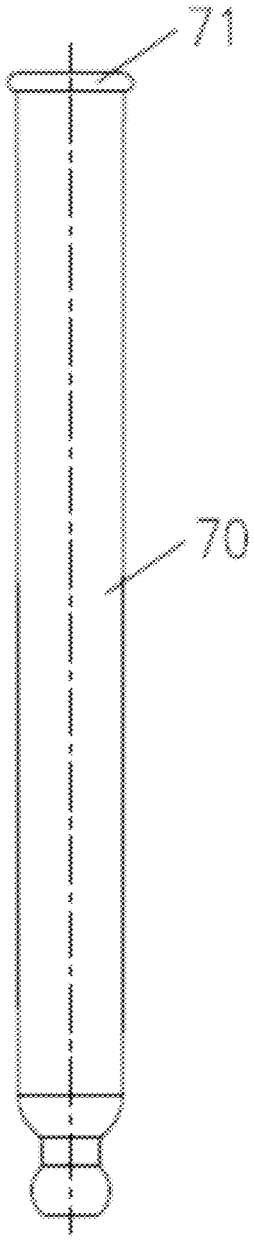
FIG. 12 is a front view of the dropper according to the present invention.

As shown in FIG. 8, the movement area on the inner cylinder 62 is a notch with a surface recessed inward. The grade adjusting rib 12 on the button rotates in the movement area and is stopped by other areas of the inner cylinder. The stepped grooves 64 are arranged vertically along the movement area, and the openings of the upper ends of all stepped grooves 64 are located at an identical level. When the button is in a natural state, the lowest end of the grade adjusting rib 12 is flush with the openings of the stepped grooves 64. An arc protrusion is arranged between two adjacent stepped grooves 64. At least one stepped groove 64 exactly receives the grade adjusting rib 12 of the button, that is, the button is not allowed to move down when the grade adjusting rib is in this stepped groove. Namely, one of the stepped grooves corresponds to a stopping grade, and the grade adjusting rib 12 is adjusted to the stopping grade when not in use, so that the button cannot be pressed downward to prevent faulty operation. In the present embodiment, as shown in FIG. 9, four stepped grooves 64 in total, which correspond to the first grade, the second grade, the third grade and the fourth grade, respectively, are provided. The first grade is the deepest, and the fourth grade is the stopping grade. Assuming that the first grade may retrieve cosmetics with a volume of a, the second grade may retrieve cosmetics with a volume of ⅔ a, and the third grade may retrieve cosmetics with a volume of ⅓ a. For convenience of use, an indication arrow is arranged on the outside of the button, and discharge-quantity indication marks and grading marks corresponding to different stepped grooves in the inner cover are arranged on the outer cover. The button is rotated to enable the indication arrow on the outside of the button to correspond to different grades, and then the button is pressed to take out the material with a quantity identical to the discharge quantity on the indication mark, so as to meet the different needs of users. The arc protrusion enables the users to relatively increase certain strength when adjusting the grade, while providing a sense of touch, thereby improving the accuracy of adjusting the grade.

The inner cylinder 62 is provided with two symmetrical movement areas, and an identical number of stepped grooves 64 are arranged in each of the two movement areas. The button is correspondingly provided with two grade adjusting ribs 12. In this way, when the button is rotated, the two grade adjusting ribs are capable of being inserted into the stepped grooves 64 of the same grade at the same time, thus improving the stability of operation and the sense of symmetry.

The mounting groove 67 is arranged in the inner cover 60, and the gasket 40 is mounted in the mounting groove. The gasket 40 is hermetically arranged at the opening of the container body 80 to prevent the cosmetics in the container body from leaking. A scraping member is sleeved on the opening of the container body 80, and the inner wall of the scraping member is tightly sleeved on the outer wall of the dropper 70. The scraping member (not shown) is tightly sleeved on the outer wall of the dropper, so that when the cover body is unscrewed to use the cosmetics, the scraping member is capable of scraping off the cosmetics adhered to the outer wall of the dropper, which avoids the waste of the cosmetics and prevent the cosmetics from contaminating other objects.

The assembly process and the use process of the present invention are as follows.

Figure 13:
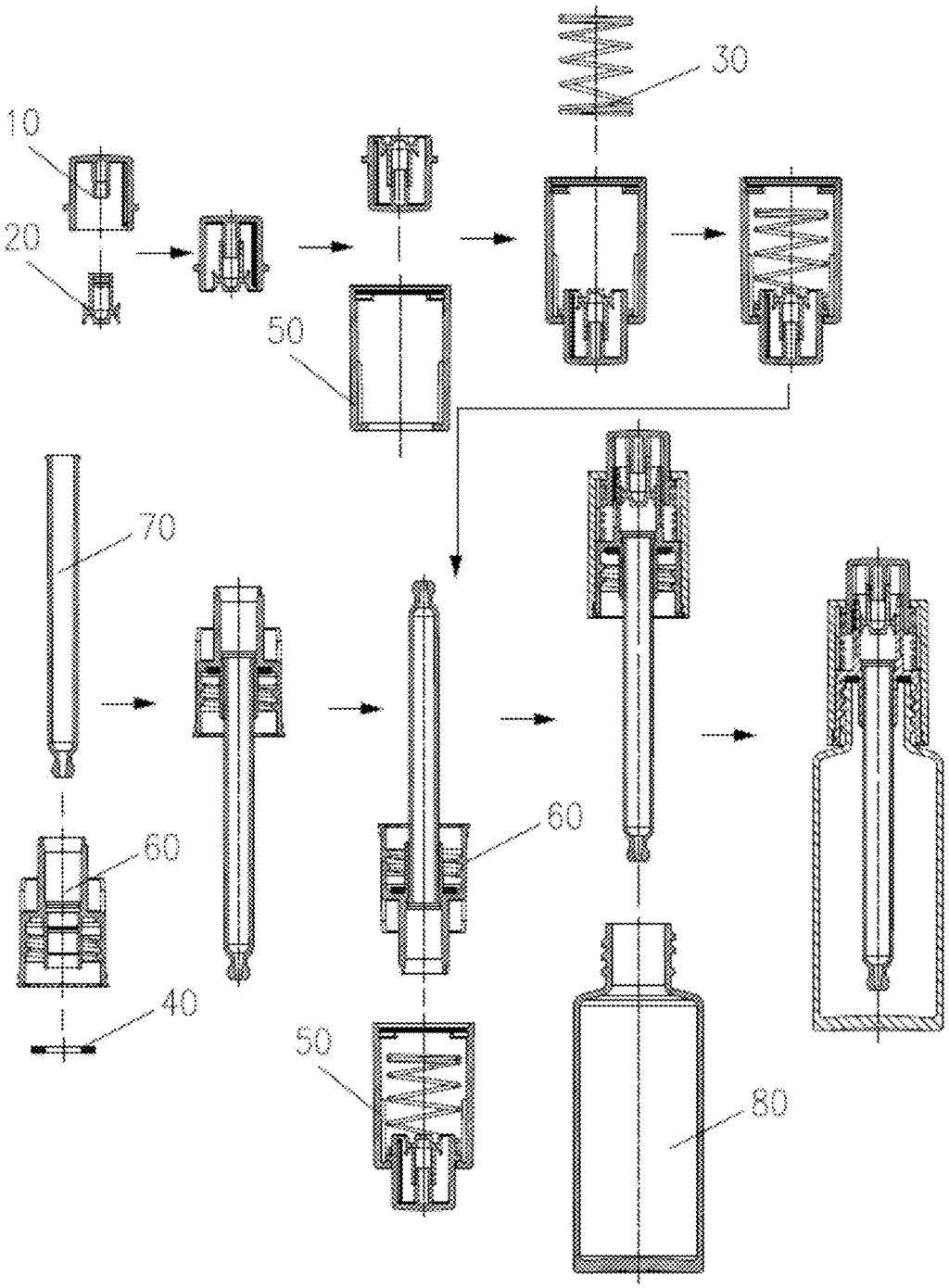
FIG. 13 is a schematic diagram of the assembly process of the present invention.

Assembly process: as shown in FIG. 13, the arrows indicate the assembly direction and the flow direction.

Step 1: the piston 20 is sleeved on the piston connecting rod 11 of the button.

Step 2: the button 10 with the piston mounted is placed into the outer cover 50, and the elastic member 30 is placed inside the outer cover and sleeved on the outer side of the button to obtain an outer cover assembly.

Step 3: the dropper 70 is inserted into the inner cover 60 from the upper part of the inner cylinder 62 to enable the flange of the dropper to be mounted in the receiving groove 65 in the inner cover, and then the gasket 40 is mounted in the mounting groove 67 of the inner cover to obtain an inner cover assembly.

Step 4: the inner cover assembly is mounted in the outer cover assembly to enable the inner cylinder in the inner cover to be inserted between the piston and the button, and the container body 80 is tightly screwed to the inner cover to complete the assembly.

Use process: the present invention is suitable for liquid cosmetics. In use, the user rotates the cover body to separate the cover body from the container body 80, and then rotates the indication arrow on the top button 10 to a position corresponding to the desired grade. The button is pressed so that the piston 20 moves down along the inner wall of the inner cylinder to squeeze the air out of the dropper. After the user releases the button, the button drives the piston 20 to move upward under the elastic force of the elastic member (i.e., the spring), so that the dropper retrieves the cosmetics. The user only needs to remove the cover body and then press the button 10 to squeeze out the cosmetics in the dropper for use. After use, the button is rotated to the stopping grade, and the cover body is tightly screwed to the container body for subsequent use.

It should be pointed out that, for those having ordinary skill in the art, various transformations and improvements can be made without departing from the inventive concept of the present invention, and these transformations and improvements shall fall within the scope of protection of the present invention. Therefore, the scope of protection of the present invention shall be subject to the appended claims.

What is claimed is:

1. A cosmetic container with an adjustable discharge quantity, comprising:

a container body, wherein an upper part of the container body is provided with an opening;

an inner cover, wherein an inner wall of the inner cover is threadedly connected to the opening of the container body, and the inner cover extends upward to form an inner cylinder; an outer wall of the inner cylinder is provided with a movement area, and a plurality of stepped grooves with different depths are arranged in parallel in the movement area; a lower end of the inner cover is hermetically connected to a dropper;

an outer cover, wherein the outer cover is sleeved on an outer side of the inner cover, and the outer cover is fixedly connected to the inner cover;

a button, wherein the button is inserted between the inner cover and the outer cover, and the button is stopped by the outer cover; an inner wall of the button is provided with a grade adjusting rib, and a center of the button extends downward to form a piston connecting rod; the grade adjusting rib is aligned with the plurality of stepped grooves by rotating the button, and then the grade adjusting rib moves down along a stepped groove of the plurality of stepped grooves to a bottom of the stepped groove by pressing the button;

a piston, wherein the piston is sleeved on the piston connecting rod of the button, and the piston and the button jointly move up and down; and an elastic member, wherein the elastic member elastically supports the button.

2. The cosmetic container according to claim 1, wherein the inner cover extends upward to form an outer cylinder and form the inner cylinder inside the outer cylinder, and a gap is formed between the outer cylinder and the inner cylinder;

a connecting tube extending downward is arranged under the inner cylinder, and an inner side of the connecting tube is provided with a receiving groove;

an upper end of the dropper is provided with a flange extending radially outward;

the dropper is inserted in the connecting tube, and the flange is exactly fixed in the receiving groove; and the inner cylinder communicates with the connecting tube.

3. The cosmetic container according to claim 1, wherein an upper end of the outer cover forms a stopping portion extending radially inward, and an outer wall of the button forms a stopping ring extending radially outward; and the stopping ring exactly abuts an inner side of the stopping portion of the outer cover during installation.

4. The cosmetic container according to claim 1, wherein the piston is hermetically attached to an inner wall of the inner cylinder, and the piston is fixedly engaged with the piston connecting rod of the button.

5. The cosmetic container according to claim 1, wherein the elastic member is sleeved on the button, and the elastic member is located in the inner cover; an upper end of the elastic member abuts the button, and a lower end of the elastic member abuts the inner cover.

6. The cosmetic container according to claim 1, wherein a mounting groove is arranged in the inner cover, and a gasket is mounted in the mounting groove; and the gasket is hermetically arranged at the opening of the container body.

7. The cosmetic container according to claim 1, wherein a scraping member is sleeved on the opening of the container body, and an inner wall of the scraping member is tightly sleeved on an outer wall of the dropper.

8. The cosmetic container according to claim 1, wherein the movement area on the inner cylinder is a notch, and a surface of the notch is recessed inward;

the grade adjusting rib on the button rotates in the movement area, and the grade adjusting rib is stopped by non-movement areas of the inner cylinder;

the plurality of stepped grooves are arranged vertically along the movement area, and openings of upper ends of the plurality of stepped grooves are located at an identical level; and when the button is not pressed, a lowest end of the grade adjusting rib is flush with the openings of the plurality of stepped grooves.

9. The cosmetic container according to claim 8, wherein an arc protrusion is arranged between two adjacent stepped grooves of the plurality of stepped grooves; and at least one stepped groove of the plurality of stepped grooves exactly receives the grade adjusting rib of the button, and the button is not allowed to move down when the grade adjusting rib is in the at least one stepped groove.

10. The cosmetic container according to claim 8, wherein the inner cylinder is provided with two symmetrical movement areas, and an identical number of the plurality of stepped grooves are arranged in each of the two symmetrical movement areas; and the button is provided with two grade adjusting ribs corresponding to the two symmetrical movement areas.

* * * * *